US008857540B2

(12) United States Patent
Blake

(10) Patent No.: US 8,857,540 B2
(45) Date of Patent: Oct. 14, 2014

(54) METHOD AND APPARATUS FOR RELEASING GAS PRESSURE FROM A DRILL STRING

(76) Inventor: Adam Paul Blake, Hanna (CA)

( * ) Notice: Subject to any disclaimer, the term of this patent is extended or adjusted under 35 U.S.C. 154(b) by 135 days.

(21) Appl. No.: 13/359,390

(22) Filed: Jan. 26, 2012

(65) Prior Publication Data

US 2013/0192849 A1 Aug. 1, 2013

(51) Int. Cl.
*E21B 21/10* (2006.01)

(52) U.S. Cl.
USPC ..... 175/318; 166/321; 166/324; 166/325; 166/332.7; 175/205; 175/69; 175/71

(58) Field of Classification Search
USPC ..... 175/318, 69, 71, 205; 166/324, 325, 166/332.7
See application file for complete search history.

(56) References Cited

U.S. PATENT DOCUMENTS 2,771,091 A * 11/1956 Baker et al. ..... 137/542
4,231,389 A 11/1980 Still
4,948,092 A 8/1990 Kasper
4,967,791 A * 11/1990 Sternberger ..... 137/522
6,095,190 A 8/2000 Wilcox

* cited by examiner

*Primary Examiner* — Jennifer H Gay
*Assistant Examiner* — George Gray
(74) *Attorney, Agent, or Firm* — Christensen O'Connor Johnson Kindness PLLC

(57) ABSTRACT

An apparatus for releasing gas pressure from a drill string includes a tubular housing having a circumferential sidewall, an axis, a first end, a second end and a central passage extending between the first end and the second end. A pressure member is positioned in the central passage along the axis of the housing. The pressure member is movable from a first position retracted within the housing to a second position extending past the second end of the housing. An actuator is provided to move the pressure member from the first position to the second position, where the pressure member exerts a force to move a valve member of a float valve to an open position, thereby allowing gas trapped in the drill string to flow through the central passage.

10 Claims, 4 Drawing Sheets

METHOD AND APPARATUS FOR RELEASING GAS PRESSURE FROM A DRILL STRING

FIELD

This relates to an apparatus for releasing gas pressure from a drill string and method of using the apparatus.

BACKGROUND

Underbalanced drilling is a process used on gas wells where the internal pressure in the hole or wellbore is at a lower pressure than that of the fluid pressure in the formation being drilled. This results in formation fluid flowing into the wellbore and up to the surface as the hole is being drilled. To assist in this operation, inert gas, such as nitrogen gas, is injected into the drilling mud to reduce its density and thus its hydrostatic force throughout the well depth. The process of controlling such an operation is fraught with dangers such as high pressures and working at elevated locations, and it consumes much time when done properly and safely.

The current method of releasing the gas pressure involves having a worker stationed on the drilling rig floor manually attach a hose attached to a string float for bleeding of the gas. The hose is subject to freezing in cold weather. The task of attaching the hose is potentially dangerous as the worker is required to stand on a ladder to access the float valve. What is needed is a safer way of releasing gas pressure from a drill string.

SUMMARY

According to one aspect, there is provided an apparatus for releasing gas pressure from a drill string. The apparatus includes a tubular housing having a circumferential sidewall, an axis, a first end, a second end and a central passage extending between the first end and the second end. A pressure member is positioned in the central passage along the axis of the housing. The pressure member is movable from a first position retracted within the housing to a second position extending past the second end of the housing. An actuator is provided to move the pressure member from the first position to the second position where the pressure member exerts a force to move a valve member of a float valve to an open position, thereby allowing gas trapped in the drill string to flow through the central passage.

The apparatus, as described above, is used to remotely open the valve member of a float valve. Gas exiting the float valve passes up through the central passage of the housing of the apparatus, eliminating the use of hoses. The actuator used can be either mechanical or hydraulic.

There are various types of hydraulic actuators which could be used. There will hereinafter be described a hydraulic actuator which has a hydraulic chamber encircling a movable pressure member support within the central passage. A fluid port extends through the sidewall of the housing and having a first end communicating with an exterior of the housing and a second end communicating with hydraulic chamber. Hydraulic fluid is injected into the hydraulic chamber from an external hydraulic fluid source connected to the first end of the fluid port. This results in axial motion of the movable pressure member support which acts as an actuator piston to move the pressure member from the first position to the second position to bring the pressure member into engagement with the valve member of the float valve.

There are various types of mechanical actuators which could be used. There will hereinafter be illustrated and described a mechanical actuator which includes a drive shaft that extends through the sidewall of the housing. The drive shaft has a first end positioned outside of the housing and a second end positioned within the central passage. A motor is provided which provides a rotary force to the drive shaft. The pressure member is supported within the central passage of the housing by a stationary pressure member support. A mechanical linkage converts rotary motion of the drive shaft into axial motion of the pressure member to move the pressure member from the first position to the second position to bring the pressure member into engagement with the valve member of the float valve. The mechanical linkage illustrated includes a threaded coupling between the pressure member and the stationary pressure member support, which causes the pressure member to move along the stationary pressure member support if a rotational force is impart to the pressure member. A gear profile on the drive shaft meshes with a gear profile on the pressure member to impart a rotational force to move the pressure member along the stationary pressure member support to the second position.

According to another aspect, there is provided a method for releasing gas pressure from a drill string using the apparatus described above. The method involves connecting the first end of the housing to a top drive of a drilling rig and connecting the second end of the housing to a float valve having a valve member. The actuator moves the pressure member to the second position, where the pressure member exerts a force to move the valve member of the float valve to an open position, thereby allowing gas trapped in the drill string to flow through the central passage of the housing.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
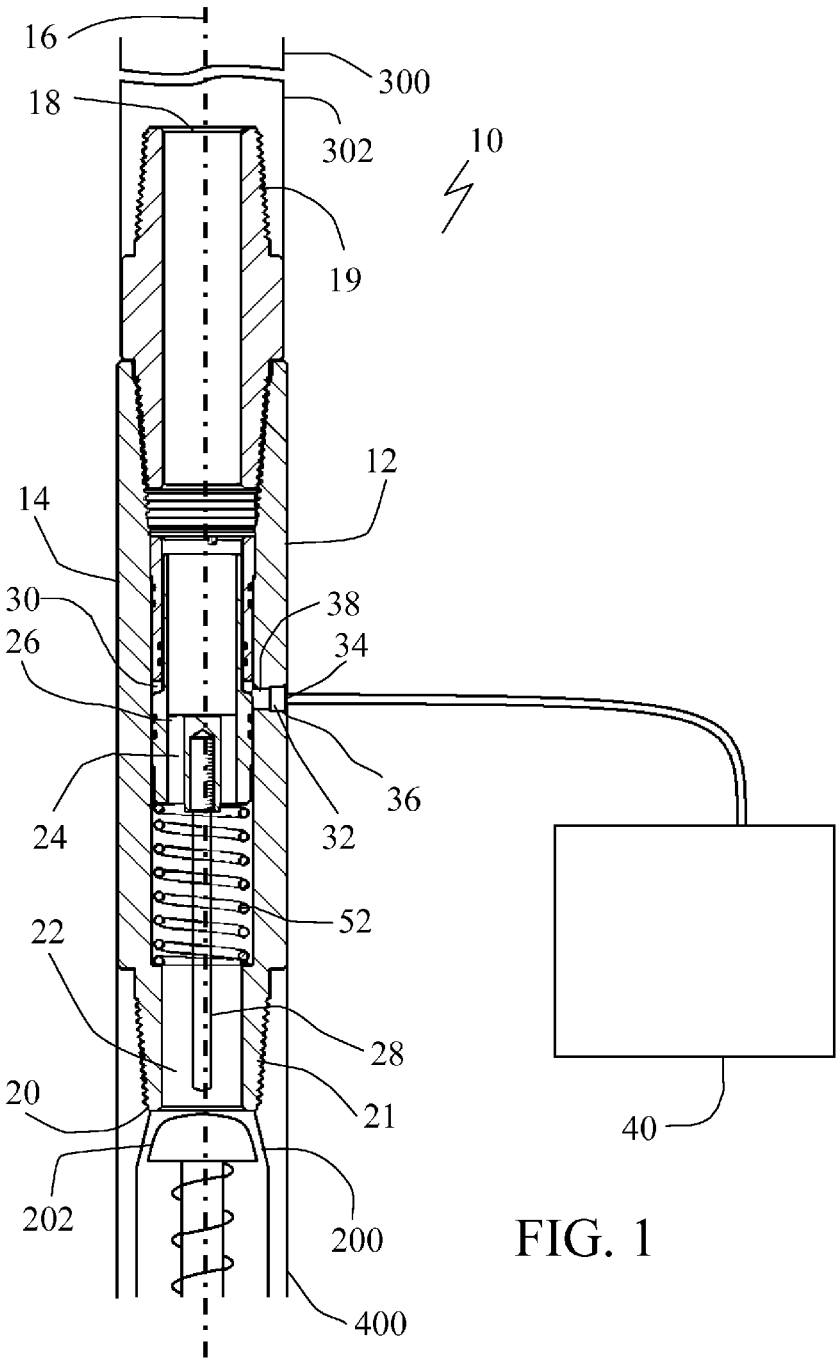
FIG. 1 is a side elevation view, in section, of an apparatus for releasing gas pressure from a drill string with a hydraulic actuator and the pressure member retracted.

There will now be described an apparatus for releasing gas pressure from a drill string with reference to FIGS. 1 through 4. A preferred embodiment with a hydraulic actuator generally identified by reference numeral 10, will be described with reference to FIGS. 1 through 3. An alternative embodiment with a mechanical actuator generally identified by reference numeral 100, will be described with reference to FIG. 4.

Figure 2:
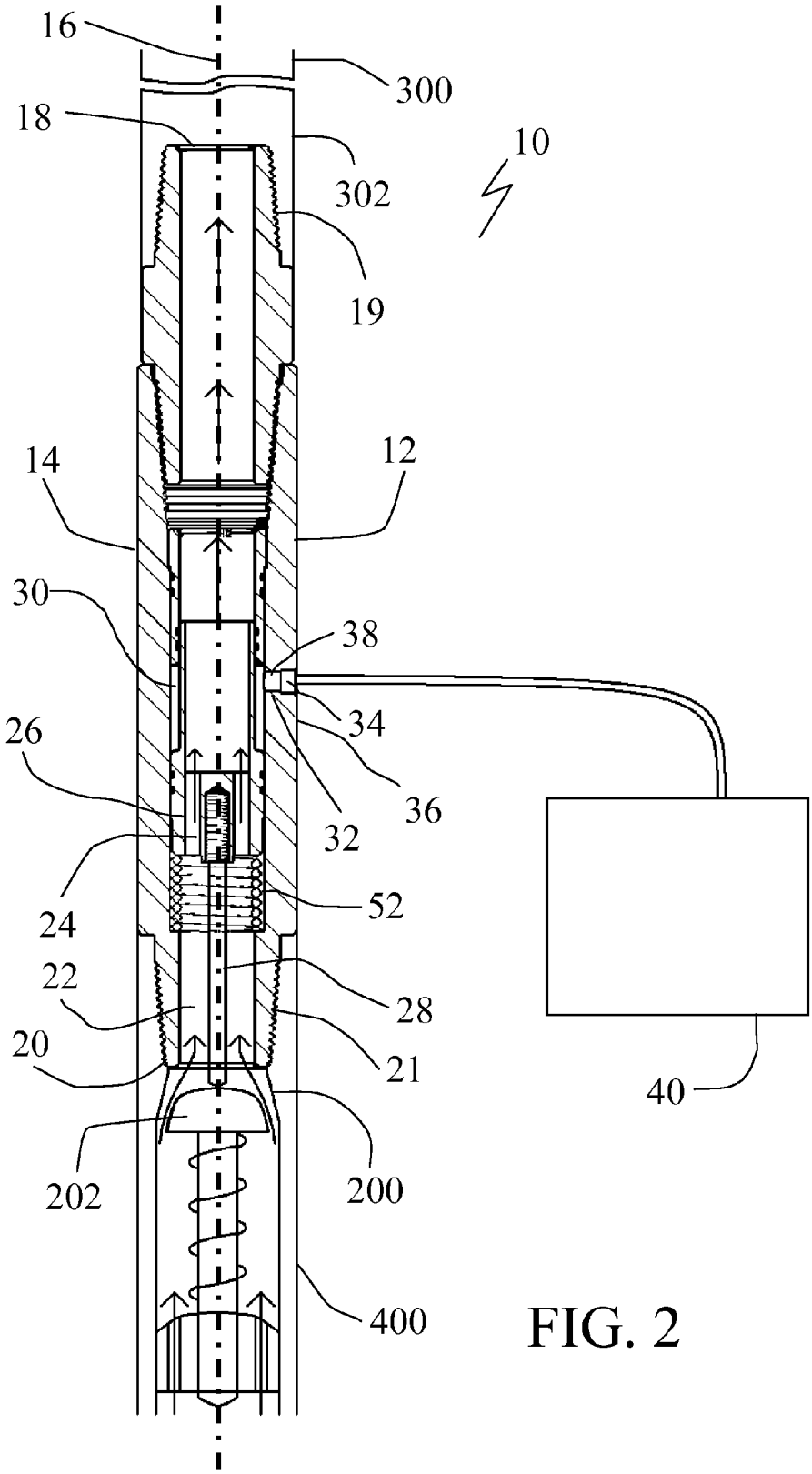
FIG. 2 is a side elevation view, in section, of the apparatus for releasing gas pressure from a drill string of FIG. 1, with the pressure member extended.
Figure 4:
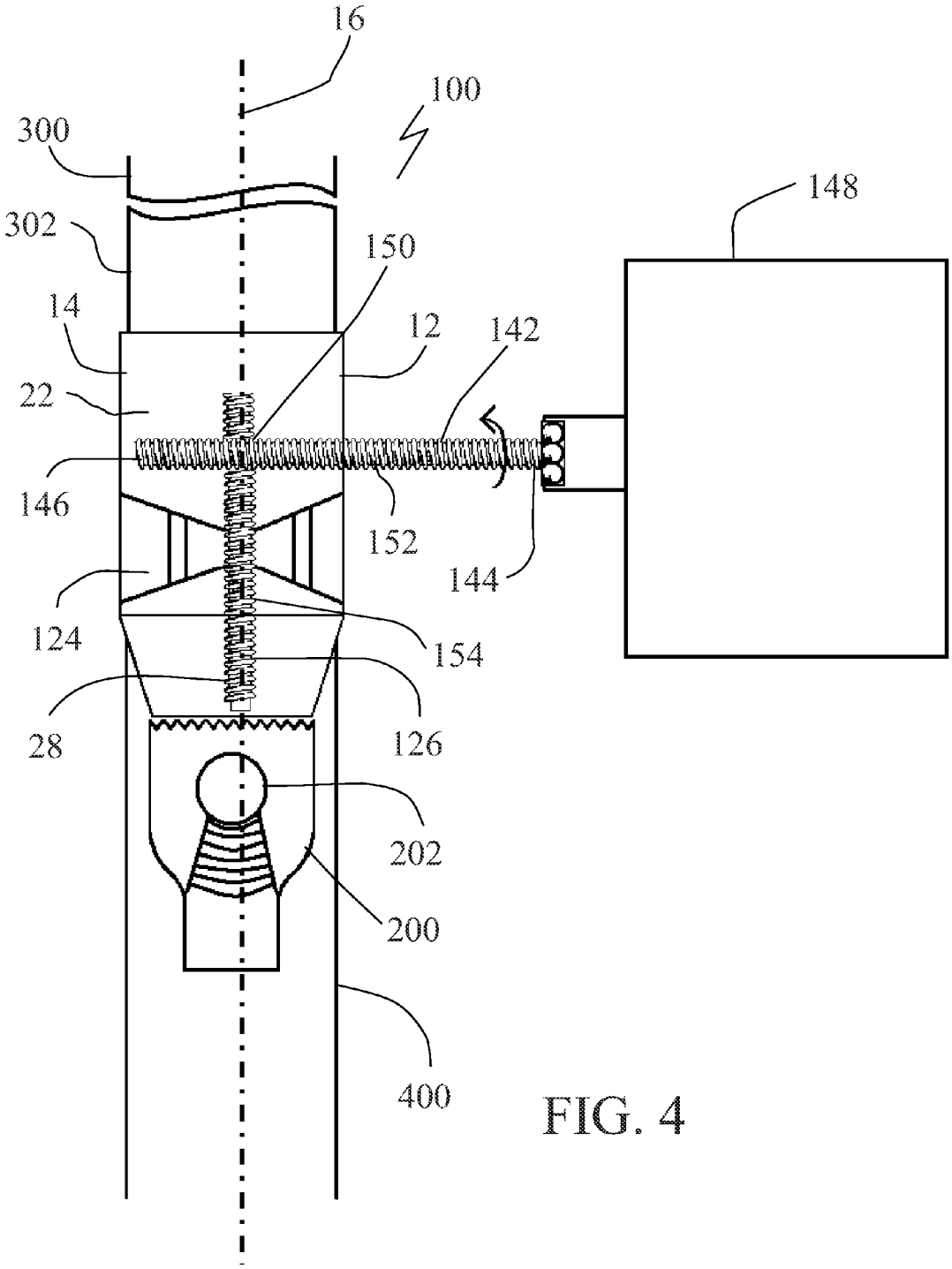
FIG. 4 is a side elevation view, in section, of an apparatus for releasing gas pressure from a drill string with a mechanical actuator and the pressure member retracted.

Structure and Relationship of Parts:

Referring to FIGS. 1 and 2, there will first be described those aspects that are common to both apparatus 10 and apparatus 100. A tubular housing 12 is provided having a circumferential sidewall 14, an axis 16, a first end 18, a second end 20 and a central passage 22 extending between first end 18 and second end 20. A pressure member 28 is positioned in central passage 22 along axis 16 of housing 12. Pressure member 28 is movable from a first position retracted within housing 12 to a second position extending past second end 20 of housing 12. An actuator is used to move pressure member 28 from the first position (illustrated in FIG. 1) to the second position (illustrated in FIG. 2). The actuator will hereinafter be further described. A hydraulic actuator 26 is illustrated in FIGS. 1 and 2. A mechanical actuator 126 is illustrated in FIG. 4 and will hereinafter be described under the heading Variations. As will hereinafter be further described, when second end 20 of housing 12 is coupled to a float valve 200, the movement of pressure member 28 to the second position exerts a force to move a valve member 202 of float valve 200 to an open position. This allows gas trapped in the drill string 400 to flow through central passage 22 of housing 12. The preferred positioning of housing 12 in the drill string 400 is coupled to a kelly 302 of a top drive 300 of a drilling rig. First end 18 of housing 12 has a pin end connection 19 to facilitate coupling with kelly 302 and top drive 300. Second end 20 of housing 12 also has a pin end connection 21 to facilitate coupling with float valve 200.

Figure 3:
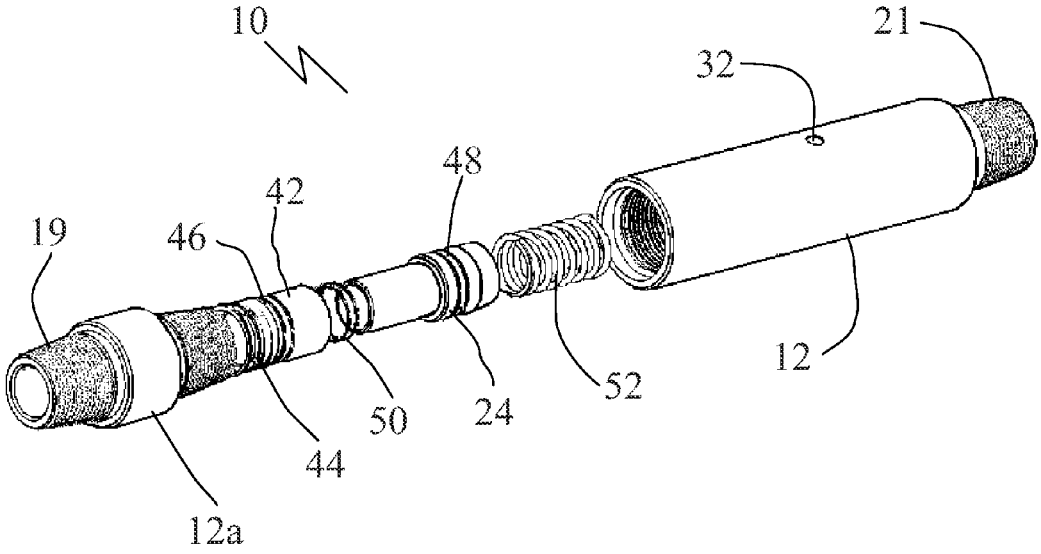
FIG. 3 is an exploded perspective view, of the apparatus for releasing gas pressure from a drill string of FIG. 1.

Referring to FIGS. 1 and 2, hydraulic actuator 26 includes a movable pressure member support 24, which acts as an actuator piston. A hydraulic chamber 30 encircles movable pressure member support 24 within central passage 22 of housing 12. A fluid port 32 extends through sidewall 14 of housing 12. Fluid port 32 has a first end 34 communicating with an exterior 36 of housing 12 and a second end 38 communicating with hydraulic chamber 30. Hydraulic fluid is injected into hydraulic chamber 30 from an external hydraulic fluid source 40 connected to first end 34 of fluid port 32, results in axial motion of movable pressure member support 24. This moves pressure member 28 from the first position to the second position to bring pressure member 28 into engagement with valve member 202 of float valve 200. Referring to FIG. 3, for clarity an exploded view of the components of apparatus 10 are illustrated. Those components include housing 12, a pin connector 12*a* that forms part of housing 12, a actuator bushing 42 within which movable pressure member support 24 (which serves as an actuator piston) moves, a retaining ring 44 is provided to lock actuator bushing 42 within housing 12. To assist in forming hydraulic chamber 30 there are O-ring seals 46 between actuator bushing 42 and housing 12, as well as O-ring seals 48 between movable pressure member support 24 (actuator piston) and housing 12, and O-ring seals 50 between movable pressure member support 24 (actuator piston) and actuator bushing 42. A spring 52 is provided to bias movable pressure member support 24 into the first position.

Operation:

Referring to FIG. 1, in order to safely actuate float valve 200, apparatus 10 is positioned in drill string 400 directly above float valve 200. The preferred positioning of apparatus 10 is secured to kelly 302 of top drive 300. FIG. 1 shows float valve 200 closed and pressure member 28 in the first position. Referring to FIG. 2, hydraulic fluid is injected into hydraulic chamber 30 from hydraulic fluid source 40 connected to first end 34 of fluid port 32. As hydraulic chamber 30 fills with hydraulic fluid, movable pressure member support 24 moves axially in housing 12 overcoming the biasing force of spring 52 to move pressure member 28 from the first position to the second position. In the second position, pressure member 28 exerts a force upon valve member 202 of float valve 200 to move valve member 202 to an open position. This allows gas trapped in drill string 400 to flow past valve member 202 and through central passage 22 of apparatus 10.

Variations:

Referring to FIG. 4, there is illustrated how the same result can be obtained through use of mechanical actuator 126. Mechanical actuator 126 includes a drive shaft 142 that extends through sidewall 14 of housing 12. Instead of a movable pressure member support, a stationary pressure member support 124 is provided. Stationary pressure member support 124 supports pressure member 28 along axis 16 of housing 12. Drive shaft 142 has a first end 144 positioned outside of housing 12 and a second end 146 positioned within central passage 22. A motor 148 is provided which provides a rotary force to rotate drive shaft 142. A mechanical linkage 150 converts rotary motion of drive shaft 142 into axial motion of pressure member 28 to move pressure member 28 from the first position to the second position to bring pressure member 28 into engagement with valve member 202 of float valve 200. Mechanical linkage 150 includes a threaded coupling between pressure member 28 and stationary pressure member support 124, which causes pressure member 28 to move along stationary pressure member support 124 if a rotational force is impart to pressure member 28. A gear profile 152 on drive shaft 142 meshes with a gear profile 154 on pressure member 28 to rotate pressure member 28. As pressure member 28 rotates it travels along stationary pressure member support 124 to the second position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. An apparatus for releasing gas pressure from a drill string comprising:

a tubular housing having a circumferential sidewall, an axis, a first end, a second end and a central passage extending between the first end and the second end;

a pressure member positioned in the central passage along the axis of the housing, the pressure member being movable from a first position retracted within the housing to a second position extending past the second end of the housing; and an actuator to move the pressure member from the first position to the second position, where the pressure member exerts a force to move a valve member of a float valve to an open position, thereby allowing gas trapped in the drill string to flow through the central passage.

2. The apparatus of claim 1, wherein the actuator is a mechanical actuator, comprising:

a stationary pressure member support to support the pressure member, a drive shaft extending through the sidewall of the housing, the drive shaft having a first end positioned outside of the housing and a second end positioned within the central passage;

a motor imparting a rotary force to rotate the drive shaft; and a mechanical linkage converting rotary motion of the drive shaft into axial motion of the movable member to move pressure member along the stationary pressure member support from the first position to the second position.

3. The apparatus of claim 2, wherein the mechanical linkage includes a threaded coupling between the pressure member and the stationary pressure member support, which causes the pressure member to move along the stationary pressure member support if a rotational force is imparted to the pressure member, a gear profile on the drive shaft meshes with a gear profile on the pressure member to impart a rotational force to move the pressure member along the stationary pressure member support to the second position.

4. The apparatus of claim 1, wherein the actuator is a hydraulic actuator, comprising:

a movable pressure member support to support the pressure member;

a hydraulic chamber encircling the movable pressure member support within the central passage;

a fluid port extending through the sidewall of the housing and having a first end communicating with an exterior of the housing and a second end communicating with the hydraulic chamber, such that hydraulic fluid injected into the hydraulic chamber from an external hydraulic fluid source connected to the first end of the fluid port results in axial motion of the movable pressure member support to move pressure member from the first position to the second position.

5. The apparatus of claim 4, wherein the pressure member is biased into the first position by a spring which exerts a biasing force upon the movable pressure member support.

6. A method for releasing gas pressure from a drill string comprising:

providing an apparatus comprising:

a tubular housing having a circumferential sidewall, an axis, a first end, a second end and a central passage extending between the first end and the second end;

a pressure member positioned along the axis of the central passage of the housing, the pressure member being movable from a first position retracted within the housing to a second position extending past the second end of the housing;

an actuator to move the pressure member from the first position to the second;

connecting the first end of the housing to a top drive of a drilling rig;

connecting the second end of the housing to a float valve having a valve member;

actuating the actuator to move the pressure member to the second position where the pressure member extending past the second end of the housing exerts a force to move the valve member of the float valve to an open position, thereby allowing gas trapped in the drill string to flow through the central passage.

7. The method of claim 6, wherein the actuator is a mechanical actuator, comprising:

a stationary pressure member support to support the pressure member, a drive shaft extending through the sidewall of the housing, the drive shaft having a first end positioned outside of the housing and a second end positioned within the central passage;

a motor imparting a rotary force to rotate the drive shaft; and a mechanical linkage converting rotary motion of the drive shaft into axial motion of the movable member to move pressure member along the stationary pressure member support from the first position to the second position.

8. The method of claim 7, wherein the mechanical linkage includes a threaded coupling between the pressure member and the stationary pressure member support, which causes the pressure member to move along the stationary pressure member support if a rotational force is imparted to the pressure member, a gear profile on the drive shaft meshes with a gear profile on the pressure member to impart a rotational force to move the pressure member along the stationary pressure member support to the second position.

9. The method of claim 6, wherein the actuator is a hydraulic actuator, comprising:

a movable pressure member support to support the pressure member;

a hydraulic chamber encircling the movable pressure member support within the central passage;

a fluid port extending through the sidewall of the housing and having a first end communicating with an exterior of the housing and a second end communicating with the hydraulic chamber, such that hydraulic fluid injected into the hydraulic chamber from an external hydraulic fluid source connected to the first end of the fluid port results in axial motion of the movable pressure member support to move pressure member from the first position to the second position.

10. The method of claim 9, wherein the pressure member is biased into the first position by a spring which exerts a biasing force upon the movable pressure member support.

* * * * *